US009453295B2

(12) United States Patent
Bae et al.

(10) Patent No.: US 9,453,295 B2
(45) Date of Patent: Sep. 27, 2016

(54) WASHING MACHINE INCLUDING A MICRO BUBBLE GENERATION UNIT

(71) Applicant: Dongbu Daewoo Electronics Corporation, Seoul (KR)

(72) Inventors: Hyung Gon Bae, Seoul (KR); Bae Gyun Kim, Seoul (KR); Ji Ae Jeong, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 251 days.

(21) Appl. No.: 14/169,065

(22) Filed: Jan. 30, 2014

(65) Prior Publication Data

US 2015/0176170 A1 Jun. 25, 2015

(30) Foreign Application Priority Data

Dec. 24, 2013 (KR) ..... 10-2013-0161970

(51) Int. Cl.

| | |
|---|---|
| ***D06F 35/00*** | (2006.01) |
| ***D06F 17/02*** | (2006.01) |
| ***D06F 39/08*** | (2006.01) |
| ***D06F 17/12*** | (2006.01) |

(52) U.S. Cl.

CPC ..... *D06F 35/002* (2013.01); *D06F 17/12* (2013.01); *D06F 39/083* (2013.01)

(58) Field of Classification Search

CPC ..... D06F 35/002; D06F 17/12

See application file for complete search history.

(56) References Cited

U.S. PATENT DOCUMENTS 4,215,081 A * 7/1980 Brooks ..... B01F 3/04517 261/122.1
5,253,380 A * 10/1993 Lim ..... D06F 17/12 68/183
5,590,551 A * 1/1997 Hong ..... D06F 17/06 261/76
5,653,129 A * 8/1997 Jang ..... D06F 17/12 261/124
6,170,303 B1 * 1/2001 Hong ..... D06F 17/12 134/102.2
2003/0230122 A1 * 12/2003 Lee ..... D06F 35/002 68/58
2008/0250823 A1 * 10/2008 Oak ..... D06F 35/002 68/5 C
2010/0263410 A1 * 10/2010 Oak ..... D06F 17/12 68/12.05
2012/0096652 A1 * 4/2012 Choi ..... D06F 21/08 8/137
2012/0159716 A1 6/2012 Lee

FOREIGN PATENT DOCUMENTS

CN 102560977 7/2012
CN 103409976 11/2013

(Continued)

OTHER PUBLICATIONS

Machine translation of KR 10-0172887 B1 to Chun, no date.*
Korean Patent Abstracts, Publication No. 10-2006-0103977, Published Oct. 9, 2006, KIPO, Republic of Korea.

*Primary Examiner* — Joseph L Perrin

(57) ABSTRACT

A washing machine includes a main body that includes a washing unit capable of washing laundry and a micro bubble generation unit configured to generate micro bubbles and supply the generated micro bubbles to the washing unit. The micro bubble generation unit includes a circulation unit supplied with water from the washing unit and configured to pressurize the water at a high pressure, an air supplier configured to supply air, a mixer connected to the circulation unit and the air supplier, configured to mix the washing water and the air, and a slit through which the mixed water and air pass through to generate the micro bubbles.

17 Claims, 3 Drawing Sheets

(56) References Cited

FOREIGN PATENT DOCUMENTS

| | | |
|---|---|---|
| KR | 10-0172887 | 10/1998 |
| KR | 10-2000-0002183 | 1/2000 |
| KR | 10-2006-0103977 | 10/2006 |

OTHER PUBLICATIONS

Chinese Office Action dated May 23, 2016 issued in corresponding Chinese Patent Application No. 201410046732.4 and English translation thereof.

* cited by examiner

WASHING MACHINE INCLUDING A MICRO BUBBLE GENERATION UNIT

CROSS-REFERENCE TO RELATED APPLICATIONS

This application is based on and claims priority from Korean Patent Application No. 10-2013-0161970, filed on Dec. 24, 2013, the disclosure of which is incorporated herein in its entirety by reference.

TECHNICAL FIELD

The present disclosure relates to a washing machine including a micro bubble generation unit.

BACKGROUND

In general, a washing machine can automatically perform washing and rinsing laundry by supplying the laundry with an impact attributable to a flow of water.

The washing machine may be classified into a vortex type, an agitator type, and a drum type depending on the washing method. The vortex type washing machine has a pulsator on the lower side of a washing tub and can wash, rinse, and remove excess water from the laundry in the washing tub using rotational force of the pulsator. The agitator type washing machine has a similar exterior to the vortex type washing machine. The agitator type washing machine has an agitator in the washing tub and may reduce damage caused by tangled laundry. The drum type washing machine has a door at the front of the washing machine and can wash the laundry using a relatively small amount of water.

In order to improve washing efficiency, a washing machine including a bubble generation device for supplying air bubbles and/or foam to a washing tub is proposed. When bubbles generated from the bubble generation device flow into the washing tub, the bubbles burst due to contact with the laundry, thereby impacting the laundry. Accordingly, contaminants adhered to the laundry may be effectively removed.

However, the conventional washing machine is problematic in that old stains are not easily removed by the bubbles supplied into the washing tub during the washing process.

A conventional drum type washing machine may be disclosed in Korean Patent Laid-Open Publication No. 2006-0103977, filed on Oct. 9, 2006.

SUMMARY

The present disclosure provides a washing machine including a micro bubble or foam generation unit with an improved washing process.

Exemplary embodiments of the present disclosure provide a washing machine including a micro bubble (e.g., a bubble and/or foam) generation unit, including a main body that includes a washing unit capable of washing laundry and a micro bubble generation unit configured to generate micro bubbles and supply the generated micro bubbles to the washing unit. The micro bubble generation unit includes a circulation unit supplied with water from the washing unit, configured to pressurize and/or circulate the water at a high pressure, an air supplier configured to supply air (e.g., to a mixer), the mixer connected to the circulation unit and the air supplier, configured to mix the water and the air, and a slit, mesh or grid configured to pass the mixed water and air through the slit, mesh or grid and generate the micro bubbles.

Other exemplary embodiments of the present disclosure provide a washing machine including a micro bubble generation unit, including a main body configured to include a washing unit capable of washing laundry, a water supply device configured to supply water to the washing unit, and a drain configured to drain the water from the washing unit; a water outlet pipe connected to the drain and configured to ramify or divide some of the water in the drain; and a micro bubble generation unit connected to the water outlet pipe and configured to mix the water and air supplied to the micro bubble generation unit, generate micro bubbles by applying shear stress to the mixed water and air, and supply the micro bubbles to the washing unit.

The micro bubble generation unit may further include a circulation unit configured to pressurize the water supplied from the water outlet pipe at a high pressure; an air supplier configured to supply the air; a mixer connected to the circulation unit and the air supplier and configured to mix the washing water and the air; and a slit, mesh, screen or grid having holes therein, through which the water and the air pass, configured to apply shear stress to the water and the air.

Furthermore, the mixer may include a mixing body having a mixing space in which the water and air are mixed and a spiral inductor adjacent to the mixing space and configured to guide the water to the mixing space along a spiral path.

Furthermore, upwardly inclined screw threads may be in or along the inner circumferential surface of the spiral inductor.

Furthermore, the spiral inductor may comprise a pipe having a spiral shape.

Furthermore, an air supply hole through which the air is supplied may be at a point connected to the air supplier for supplying air and/or at an upper section of the mixing body. The air supply hole may have a diameter smaller than an inside diameter of the air supply pipe of the air supplier.

Furthermore, the slit, mesh or grid may include a first mesh, grid, screen or plurality of slits having relatively large holes, and a second mesh, grid, screen or plurality of slits having relatively small holes, through which the water passes.

Furthermore, the micro bubble may comprise or be an air bubble having a diameter of 50 μm or less. For example, the micro bubbles as a whole may have a size or diameter distribution in which 90% or more of the bubbles have a diameter of 50 μm or less. For example, micro bubbles may have a size or diameter distribution in which 95%, 98% or any percentage more than 90% of the bubbles have a diameter of 50 μm or less, 40 μm or less, 30 μm or less, or any other upper limit of 50 μm or less. The effectiveness of the removal of contaminants from laundry advantageously increases as the size or diameter of the micro bubbles decreases.

Embodiments of the present disclosure advantageously improve the washing process of the washing machine that includes the micro bubble generation unit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
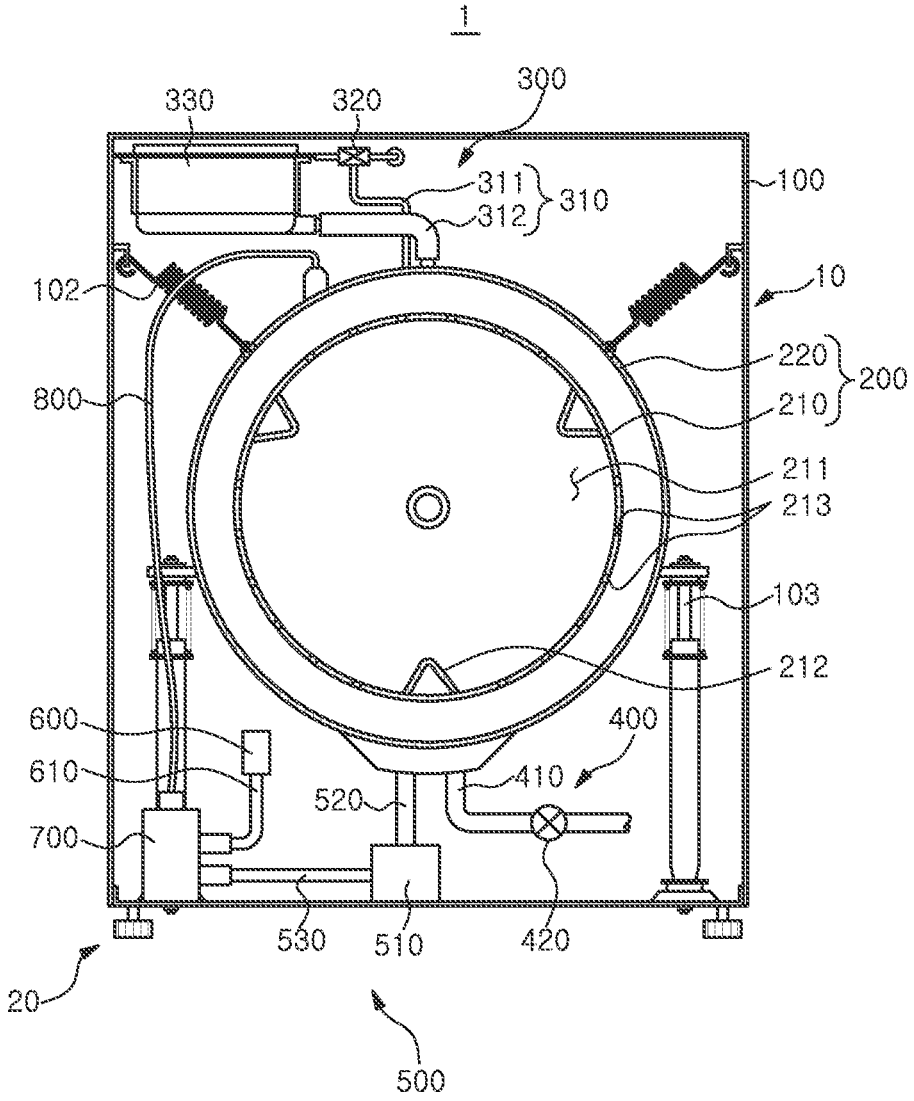
FIG. 1 is a diagram schematically showing an exemplary washing machine including a micro bubble generation unit according to embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Exemplary embodiments of the present disclosure will be described more fully hereinafter with reference to the accompanying drawings, in which the exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
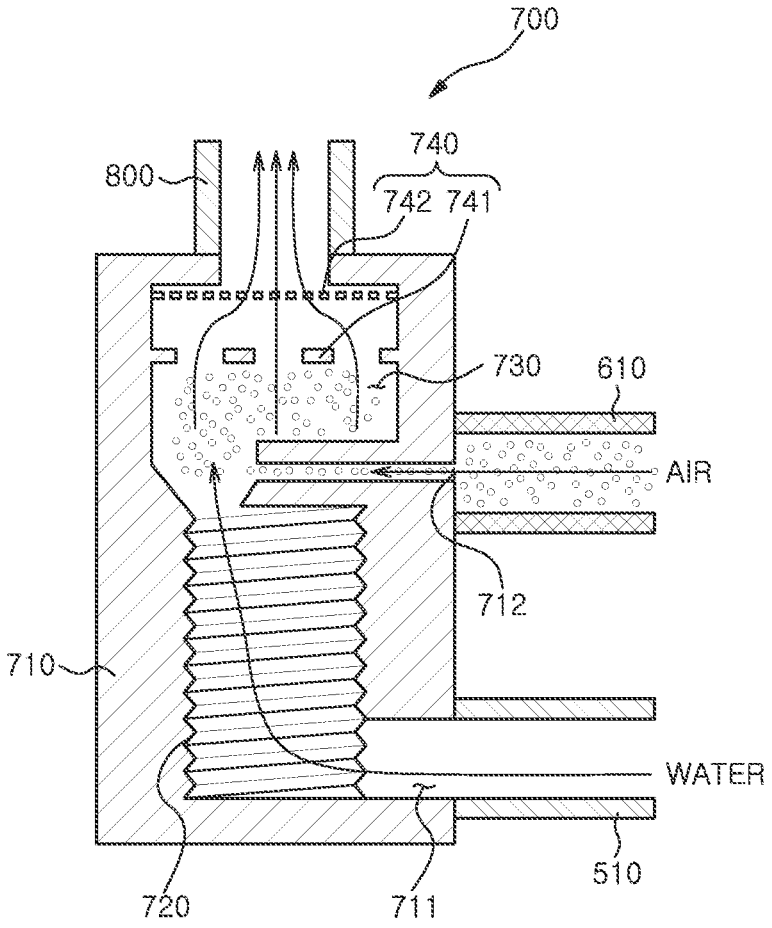
FIG. 2 is a cross-sectional view of an exemplary mixer of the micro bubble generation unit of FIG. 1.

FIG. 1 is a diagram schematically showing an exemplary washing machine including a micro bubble generation unit according to embodiments of the present disclosure, and FIG. 2 is a cross-sectional view of an exemplary mixer of the micro bubble generation unit of FIG. 1.

Referring to FIGS. 1 and 2, the washing machine 1 including a micro bubble generation unit according to embodiments of the present disclosure may include a main body 10 and a micro bubble generation unit 20.

In the present embodiments, the washing machine 1 has been illustrated as being a drum type washing machine. However, this is only illustrative and not limited thereto. Various types of washing machines may be applied to the washing machine 1. For example, the washing machine 1 may be a vortex type washing machine for washing laundry using a rotating flow of water or an agitator type washing machine for washing laundry by agitating the laundry using an agitator.

The main body 10 may include a cabinet 100 that forms an exterior part of the washing machine 1, a washing unit 200, a water supply device 300, and a drain 400.

The washing unit 200 is inside the cabinet 100 and configured to wash laundry. The washing unit 200 may include a drum 210 and a tub 220 that may be placed in the cabinet 100 horizontally.

The drum 210 includes a washing space 211 that laundry can be washed therein, and the drum 210 can be rotated by a rotation drive unit (not shown). The drum 210 may have a cylindrical shape with one side or an opened end. Several protrusions 212 for improving a washing effect or process may be on the inner circumferential surface of the drum 210. Furthermore, several through holes 213 configured to communicate with the tub 220 may be on the inner circumferential surface of the drum 210. Washing water can be introduced into the washing space 211 or may be drained from the washing space 211 through the through holes 213.

The tub 220 supports the drum 210 and has a shape corresponding to that of the drum 210. The tub 220 may be connected to the cabinet 100 by use of elastic members 102, such as springs. Dampers 103 for reducing vibration attributable to the rotation of the drum 210 may be on the lower side of the tub 220.

The water supply device 300 supplies the water to the tub 220. In addition, the water supply device 300 may include a water supply pipe 310 that may be connected to the tub 220 and an external water supply device (not shown), and a water supply valve 320 that may control the water supply. However, the water supply valve 320 is not necessary. The water supply pipe 310 may include a first water supply pipe 311 directly connected to the tub 220 and configured to supply water to the tub 220 and a second water supply pipe 312 connected to a detergent supply device 330 that may hold detergent and configured to supply water and the detergent to the tub 220.

The drain 400 is configured to drain water from the tub 220. In addition, the drain may include a water drainage pipe 410 that may be connected to the tub 220 and an external water drainage device (not shown), and a water drainage valve 420 that may control the water drainage. For smooth drainage, the drain 400 may be under a lower section of the tub 220.

The micro bubble generation unit 20 in the main body 100 is configured to provide micro bubbles to the inside of the tub 220. The micro bubbles may be provided anywhere in the tub. However, if the micro bubbles are provided at the bottom of the tub, the water has a tendency to turn a milky color. The micro bubble generation unit 20 may include a circulation unit 500, an air supplier 600, a mixer 700, and a micro bubble supply member 800.

In some embodiments, the micro bubble is an air bubble having a diameter of 50 μm or less. Alternatively, the micro bubbles have a size or diameter distribution in which 90% or more of the bubbles have a diameter of 50 μm or less. For example, the micro bubbles may have a size or diameter distribution in which 95%, 98% or any percentage greater than 90% of the bubbles have a diameter of 50 μm or less, 40 μm or less, 30 μm or less, or any other upper limit of 50 μm or less. In general, the micro bubble, unlike a common air bubble, does not necessarily burst, become extinct or disappear by rubbing, although it can burst upon contact with clothing or fabric. Micro bubbles generally have a very high surface energy to surface area ratio, and they generally release more mechanical energy per unit volume than common air bubbles, which can facilitate cleaning and improve washing efficiency. Also, after a period of time has lapsed since from the generation of the micro bubble, the micro bubble may burst, generating various types of energy. The micro bubbles, having a high surface energy, may discharge anions, ultrasonic energy, and/or heat when the burst, which is expected to facilitate the washing and sterilization process (es). Furthermore, the micro bubbles, having a small particle size, may enter very small openings or spaces in fabric, thus being capable of effectively removing contaminants from laundry. As a result, the high surface energy of the micro bubbles advantageously improves washing efficiency.

The circulation unit 500 may provide driving force so that the water can pass through the micro bubble generation unit 20 and circulate in the tub 220. The micro bubbles, together with the washing water, may be moved to the tub 220 by a driving force provided by the circulation unit 500. The circulation unit 500 may include a circulation pump 510, a water outlet pipe 520, and a water inlet pipe 530. The circulation pump 510 is supplied with the water from the washing unit 200 through the water outlet pipe 520. The circulation pump 510 can pressurize the supplied water and transfer the pressurized and/or circulated water to the mixer 700 through the water inlet pipe 530.

The air supplier 600 supplies air to the mixing member 700. A device that is capable of supplying air, such as an air pump, may be applied to the air supplier 600. Air supplied by the air supplier 600 may be supplied to the mixer 700 through an air supply pipe 610.

The mixer 700 may include a mixing body 710 having a mixing space 730, a washing water supply hole 711, and an air supply hole 712.

The mixing space 730 may be on the upper side of the mixing body 710, and the water supply hole 711 and the air supply hole 712 may be adjacent to the mixing space 730.

The washing water supply hole 711 may be at a lower section the mixing body 710. The mixing body 710 may include a spiral inductor 720 that guides an upward movement of the water, such that the water can smoothly enter the mixing space 730. The pressurized water supplied through the washing water supply hole 711 may rise in a spiral path along the inner circumferential surface of the spiral inductor 720. In the present embodiment, the spiral inductor 720 has a screw thread shape in or along the inner circumferential surface, but this is only illustrative and not limited thereto. For example, the spiral inductor 720 may comprise a pipe having a spiral shape.

The air supply hole 712 may be over the washing water supply hole 711. The air supply hole 712 has a diameter relatively smaller than an inside diameter of the air supply pipe 610, thereby being capable of increasing the speed of air flow when the air enters the mixing space 730.

The water and the air may be mixed in the mixing space 730, so the micro bubbles may be generated. The micro bubbles may be generated in such a manner that the water having a lateral stream obtained from rising through the spiral inductor 720 passes through a slit, mesh or grid 740 and experiences shear stress when the water has been mixed with the air.

The slit, mesh or grid 740 is on the back stream side of the mixing space 730, on the upper side of the mixing space 730 in the present embodiments. The slit, mesh or grid 740 may block a main stream direction of the water, such as an upward stream of the water in the present embodiments. The slit, mesh or grid 740 may include a first mesh, grid, or plurality of slits 741 having relatively large holes, and a second mesh, grid, or plurality of slits 742 having relatively small holes, through which water passes. In the present embodiments, the first plurality of slits 741 are under the second plurality of slits 742, and the number of holes formed by the plurality of second slits 742 may be larger than the number of holes formed by the plurality first slits 741. If the washing water passes through the first plurality slits 741 and then passes through the second plurality of slits 742, bubbles can be split into smaller sizes and the number of times that shear stress is applied to the water can be increased. As a result, the micro bubbles may be generated more effectively.

The water that passed through the slit, mesh or grid 740 may be supplied to the washing space 211 through the micro bubble supply member 800 connected to the washing unit 200.

The micro bubble supply member 800 may comprise a pipe along that the washing water including the micro bubbles can move. In addition, the micro bubble supply member 800 may be connected to the upper section of the tub 220, so that the water may be sprayed from the upper side of the tub 220 to the lower side of the tub 220.

An operation of the washing machine including the micro bubble generation unit according to embodiments of the present disclosure are described below.

To wash contaminated laundry, the laundry is placed in the washing space 211 of the washing unit 200, and the water and the detergent may be supplied through the first water supply pipe 311 and the second water supply pipe 312.

When the laundry, the detergent, and the water are supplied, the drum 210 rotates by the rotation drive part when the tub 220 has been closed by a cover (not shown). In contrast, the tub 220 in which the drum 210 is contained may be fixed in the cabinet 100 by the elastic members 102 and dampers 103 without being rotated.

When the drum 210 is rotated, the laundry, the water, and the detergent may be mixed, and the laundry mat move to the top of the washing space 211, while rotating between the protrusions 212 and then drop to the bottom of the washing space 211 by force of gravity. The laundry may be washed by lifting and dropping impact of the washing machine and the washing force of the detergent.

In the washing process, the water may be supplied to the circulation pump 510 through the through holes 213 in the drum 210, and the water outlet pipe 520. The water supplied to the circulation pump 510 may enter the mixer 700 through the water supply hole 711. The water may enter the mixing space 730 while being drawn up a spiral path along the inner circumferential surface of the spiral inductor 720 by pressure from the circulation pump 510.

Furthermore, the air supplied by the air supplier 600 may be supplied to the mixer 700 through the air supply pipe 610. The air may be supplied to the mixing space 730 at a high speed because the cross-sectional area of a flow path along which the air is supplied is reduced due to a difference between the inside diameter of the air supply pipe 610 and the diameter of the air supply hole 712.

Bubbles (e.g., micro bubbles) may be generated because the water supplied to the mixing space 730 in a lateral stream and the air supplied to the mixing space 730 in a longitudinal stream are mixed. The bubbles may be subject to shear stress while passing through the slit, mesh or grid 740 and split into smaller-sized bubbles by the shear stress, thereby generating the micro bubbles. Furthermore, the bubbles (e.g., micro bubbles) may be split into smaller bubbles while sequentially passing through the first plurality of slits 741 having relatively large holes and the second plurality of slits 742 having relatively small holes. Accordingly, the amount of micro bubbles generated may increase.

When the micro bubbles are generated, the micro bubbles do not necessarily disappear after a specified time, and the micro bubbles are supplied to the washing space 211 through the micro bubble supply member 800, thus contacting the laundry. After a period of time has lapsed, anions, ultrasonic energy, and heat discharged from the micro bubbles prior to the bubbles disintegrating or become extinct are transferred to the laundry, thus effectively facilitating washing and sterilizing the laundry.

As described above, the washing machine 1 including the micro bubble generation unit according to embodiments of the present disclosure may improve a washing process by washing the laundry using the micro bubbles. Furthermore, additional water is not necessary because the micro bubbles may be generated using the washing water. As a result, excessive water consumption may be reduced because the water may be reused by the circulation pump 510.

Hereinafter, a washing machine including a micro bubble generation unit according to other embodiments of the present disclosure is described with reference to FIG. 3. The present embodiment is similar to the aforementioned embodiment, except that a micro bubble generation unit is supplied with water from a washing unit. Accordingly, only the difference is chiefly described in order to avoid redundancy, and the same elements as those of the aforementioned embodiment are assigned the same reference numerals as those of the aforementioned embodiment.

Figure 3:
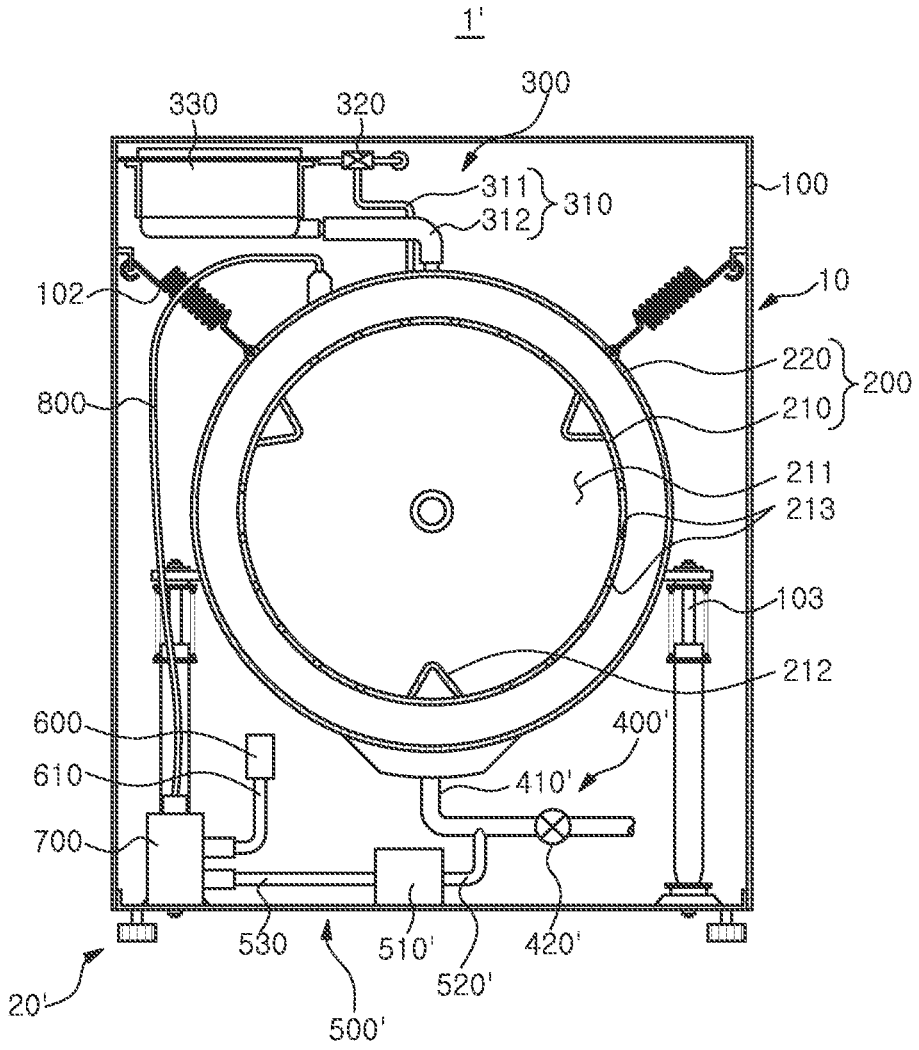
FIG. 3 is a diagram schematically showing an exemplary washing machine including a micro bubble generation unit according to other embodiments of the present disclosure.

FIG. 3 is a diagram schematically showing an exemplary washing machine including a micro bubble generation unit according to other embodiments of the present disclosure.

Referring to FIG. 3, in the washing machine 1' including the micro bubble generation unit 20' according to other embodiments of the present disclosure, the micro bubble generation unit 20' is configured supply water from a drain 400'. The drain 400' drains the water from the tub 220. The drain 400' may include a water drainage pipe 410' that may be connected to the tub 220 and an external water drainage device (not shown), and a water drainage valve 420' that may control water drainage. Furthermore, the water drainage pipe 410' may be connected to a water outlet pipe 520' connected to the circulation pump 510'. Accordingly, some of drained water may be supplied to the circulation pump 510', and the remainder of the drained water may be transferred to the external water drainage device. The amount of the water supplied to the circulation pump 510' may be controlled by the water drainage valve 420'.

Accordingly, in the washing machine 1' including the micro bubble generation unit 20' according to the present embodiments may have a simplified structure and improve manufacturing productivity because the water outlet pipe 520' is connected to the drain 400' and the water outlet pipe 520' does not need to be additionally formed in the washing unit 200.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A washing machine including a micro bubble generation unit, comprising:

a main body comprising a washing unit configured to wash laundry; and a micro bubble generation unit configured to generate micro bubbles and supply the micro bubbles to the washing unit, wherein the micro bubble generation unit comprises:

a circulation member configured to pressurize the water from the washing unit at a high pressure;

an air supplier configured to supply air;

a mixer connected to the circulation member and the air supplier, configured to mix the water and the air; and a slit, grid, screen or mesh configured to generate the micro bubbles, wherein the slit, grid, screen or mesh comprises a first member having a plurality of relatively large slits or holes therein through which the water passes, and a second member having plurality of relatively small slits or holes therein through which the water from the first member passes.

2. The washing machine of claim 1, wherein the mixer comprises:

a mixing body having a mixing space; and a spiral inductor adjacent to the mixing space configured to guide the water to the mixing space along a spiral path.

3. The washing machine of claim 2, wherein the spiral inductor includes upwardly inclined screw threads in an inner circumferential surface thereof.

4. The washing machine of claim 2, wherein the spiral inductor comprises a pipe having a spiral shape.

5. The washing machine of claim 2, further comprising:

an air supply hole to which the air is supplied is connected to the air supplier and is configured to supply air at an upper section of the mixing body, and the air supply hole has a diameter smaller than an inside diameter of the air supply pipe.

6. The washing machine of claim 1, wherein the micro bubbles comprise air bubbles having a diameter of 50 μm or less.

7. The washing machine of claim 6, wherein the micro bubbles have a size distribution in which 90% or more of the air bubbles have a diameter of 50 μm or less.

8. The washing machine of claim 1, further comprising protrusions on an inner circumferential surface of the drum.

9. The washing machine of claim 1, wherein the first member comprises a first plurality of slits or holes, and the second member comprises a second plurality of slits or holes smaller than the first plurality of slits or holes.

10. A washing machine including a micro bubble generation unit, comprising:

a main body comprises a washing unit configured to wash laundry, a water supply device configured to supply water to the washing unit, and a drain configured to drain the water from the washing unit;

a water outlet pipe connected to the drain and configured to ramify or divide the water in the drain; and a micro bubble generation unit connected to the water outlet pipe and configured to mix water and air supplied to the micro bubble generation unit, generate micro bubbles by applying shear stress to the mixed water and air, and supply the micro bubbles to the washing unit, wherein the micro bubble generation unit comprises:

a circulation unit configured to pressurize the water supplied from the water outlet pipe at a high pressure;

an air supplier configured to supply air;

a mixer connected to the circulation unit and the air supplier, configured to mix the water and the air; and a slit, grid, screen or mesh having holes therein, through which the water and the air pass, configured to apply shear stress to the water and air and wherein the slit comprises a first plurality of slits having relatively large holes and configured to pass the water through; and a second plurality of slits having relatively small holes and configured to pass the water through the first plurality of slits and the second plurality of slits.

11. The washing machine of claim 10, wherein the mixer comprises:

a mixing body having a mixing space configured to mix the water and air; and a spiral inductor adjacent to the mixing space and configured to guide the water to the mixing space along a spiral path.

12. The washing machine of claim 11, wherein the spiral inductor includes upwardly inclined screw threads in an inner circumferential surface thereof.

13. The washing machine of claim 11, wherein the spiral inductor comprises a pipe having a spiral shape.

14. The washing machine of claim 11, wherein:

an air supply hole to which the air is supplied is connected to the air supplier and is configured to supply the air to an upper section of the mixing body, and the air supply hole has a diameter smaller than an inside diameter of the air supply pipe of the air supplier.

15. The washing machine of claim 10, wherein the micro bubble comprises air bubbles having a diameter of 50 μm or less.

16. The washing machine of claim 15, wherein the micro bubbles have a size distribution in which 90% or more of the air bubbles have a diameter of 50 μm or less.

17. The washing machine of claim 10, wherein the first member comprises a first plurality of slits or holes, and the second member comprises a second plurality of slits or holes smaller than the first plurality of slits or holes.

* * * * *